US011091858B2

(12) United States Patent
Cohen

(10) Patent No.: US 11,091,858 B2
(45) Date of Patent: Aug. 17, 2021

(54) ON-LOOM FABRIC INSPECTION SYSTEM AND METHOD

(71) Applicant: USTER TECHNOLOGIES LTD., Caesarea (IL)

(72) Inventor: Shmuel Cohen, Pardesiya (IL)

(73) Assignee: USTER TECHNOLOGIES LTD, Caesarea (IL)

( * ) Notice: Subject to any disclaimer, the term of this patent is extended or adjusted under 35 U.S.C. 154(b) by 534 days.

(21) Appl. No.: 15/292,242

(22) Filed: Oct. 13, 2016

(65) Prior Publication Data

US 2017/0029988 A1 Feb. 2, 2017

Related U.S. Application Data

(63) Continuation of application No. 14/009,557, filed as application No. PCT/IB2012/051613 on Apr. 2, 2012, now Pat. No. 9,499,926.

(60) Provisional application No. 61/471,958, filed on Apr. 5, 2011.

(51) Int. Cl.
*H04N 7/18* (2006.01)
*D03J 1/00* (2006.01)

(52) U.S. Cl.
CPC ..... *D03J 1/007* (2013.01)

(58) Field of Classification Search
CPC ..... D03J 1/007
USPC ..... 348/92
See application file for complete search history.

(56) References Cited

U.S. PATENT DOCUMENTS 4,582,095 A * 4/1986 Kronholm ..... D03D 51/002 139/1 R
6,256,091 B1 * 7/2001 Kobayashi ..... G01N 21/88 356/237.1
2004/0133297 A1 * 7/2004 Vergote ..... D03D 51/18 700/140

* cited by examiner

*Primary Examiner* — Richard T Torrente
(74) *Attorney, Agent, or Firm* — Alphapatent Associates, Ltd; Daniel J. Swirsky

(57) ABSTRACT

An on-loom fabric inspection system having at least one imaging device configured to collect images of at least one section of a weaving area of a loom including a shed region, a woven fabric region and a fell region. The system is operable to detect faults in the weaving area and to produce batches of woven fabric assigned with an objective quality index.

18 Claims, 10 Drawing Sheets

ON-LOOM FABRIC INSPECTION SYSTEM AND METHOD

CROSS-REFERENCE TO RELATED APPLICATIONS

This application is a continuation application of U.S. patent application Ser. No. 14/009,557 filed on Oct. 3, 2013, which is a US National Phase Application under 35 U.S.C. 371 of International Application No. PCT/IB2012/051613, which has an international filing date of Apr. 2, 2012, and which claims the benefit of priority from U.S. Provisional Patent Application No. 61/471,958 filed on Apr. 5, 2011, all of which applications are incorporated herein by reference in their entirety.

FIELD OF THE INVENTION

The embodiments disclosed herein relate to systems and methods for on-loom fabric inspection.

BACKGROUND

The quality of woven fabric depends upon the number of defects left in the fabric after the manufacturing process. Weaving involves repeating in sequence the operations of shedding, picking, and battening. All these processes are typically carried out by a loom. Shedding is the process by which warp yarns are raised or lowered to produce a space, known as the shed, through which a filler yarn may be passed. Picking is the process of inserting a filler yarn through the shed, such that it intersects the warp threads. Battening is the process of pressing the filler yarn against the fell, where the newly woven fabric is formed.

Defects developing during any of these processes determine the quality of the finished fabric. Typically, the finished fabric is inspected for faults according to industry standards. For example, in the standard four-point system of fabric inspection, penalty points being given for detected defects. The size of the penalty depends also upon the length of the defect with 1 penalty point being given to defects of 3 inches or less, 2 penalty points being given to defects of between 3 to 6 inches, 3 penalty points being given to defects of between 6 to 9 inches and 4 penalty points being given to defects of above 9 inches. The quality of the batch of cloth is described by the number of penalty points per 100 yards of inspected cloth, with up to 40 points being generally considered an acceptable defect rate. Apart from the four-point system described above, other standards, such as the more complicated ten-point system or the Dallas System for knitted fabric, may be used to measure the quality of cloth.

Generally, a sample size of at least ten percent of rolls of finished fabric are inspected. Faults in uninspected rolls are typically left undetected until the cloth is sold on. Furthermore, although such defect inspections are standardized as far as possible, it is noted that they depend upon the subjective assessment of the inspector. What one inspector may consider to be a defect, another inspector may consider to be acceptable. Accordingly, the same roll of cloth may be assessed very differently by different inspectors regardless of its actual quality.

It will be appreciated therefore that there is a need for an improved measure of the quality of woven fabric which may be used as an objective industry standard. The systems and methods described herein come to address this need.

SUMMARY OF THE EMBODIMENTS

Accordingly, systems and methods are disclosed herein for providing on-loom inspection of woven fabrics in order to identify weaving faults during manufacture. In one aspect, an on-loom fabric inspection system is disclosed comprising at least one imaging device configured to collect images of at least one section of a weaving area of a loom and to detect at least one fault in the weaving area; wherein the section of the weaving area comprises a shed region, a woven fabric region and a fell region. Optionally, the system further comprises at least one image processor configured to receive data pertaining to the images and to identify irregularities in the data.

In some embodiments the imaging device comprises a camera.

The imaging device may be configured to image a plurality of weft yarns in the fell region. Optionally, an image processor may be operable to measure weft-spacing.

The system may further comprise an image processor operable to detect irregularities in image data indicating the occurrence of weaving faults. For example, the weaving faults may be selected from a group consisting of: slubs, holes, missing yarns, yarn variation, end out, soiled yarns, wrong yarn faults, oil spots, loom-stop marks, thin place, smash marks, open reed, mixed filling, mixed end, knots, jerk-in, dropped picks, drawbacks, burl marks and the like as well as combinations thereof.

Where appropriate, the system may further comprise a controller operable to respond to detection of weaving faults. Optionally, the controller is operable to stop the loom upon detection of critical weaving faults. Additionally or alternatively, the controller is operable to adjust the loom settings to correct for weaving faults.

In certain embodiments the controller is operable to assign a quality index to a batch of woven fabric. The quality index may be at least partially based upon deviation of weft-spacing in the fell region from a desired weft-spacing function.

In some embodiments, the image processor is configured to segment a frame of the image data and to analyze each segment separately. Optionally, each segment is analyzed at a different rate.

In certain embodiments, at least one segment shows the shed region. Alternatively, or additionally, at least one segment shows the fell region. Alternatively, or additionally, again, at least one segment shows the newly woven fabric region.

In another aspect a method is taught for inspecting woven fabric. The method comprising: providing at least one imaging device configured to collect images of at least one section of a weaving area of a loom; the imaging device collecting image data from the weaving area; the imaging device transferring the image data to an image processor; the image processor analyzing the image data for irregularities indicative of weaving faults; and recording the weaving faults. The method may optionally include a further step of adjusting the loom to correct the weaving faults. Where appropriate, the method may further include comparing deviation of weft-spacing in the fell region from a desired weft-spacing function. Accordingly the method may further provide a quality index for a batch of woven fabric.

BRIEF DESCRIPTION OF THE FIGURES

For a better understanding of the embodiments and to show how it may be carried into effect, reference will now be made, purely by way of example, to the accompanying drawings.

With specific reference now to the drawings in detail, it is stressed that the particulars shown are by way of example and for purposes of illustrative discussion of selected embodiments only, and are presented in the cause of providing what is believed to be the most useful and readily understood description of the principles and conceptual aspects. In this regard, no attempt is made to show structural details in more detail than is necessary for a fundamental understanding; the description taken with the drawings making apparent to those skilled in the art how the several selected embodiments may be put into practice. In the accompanying drawings.

DESCRIPTION OF THE SELECTED EMBODIMENTS

Figure 1:
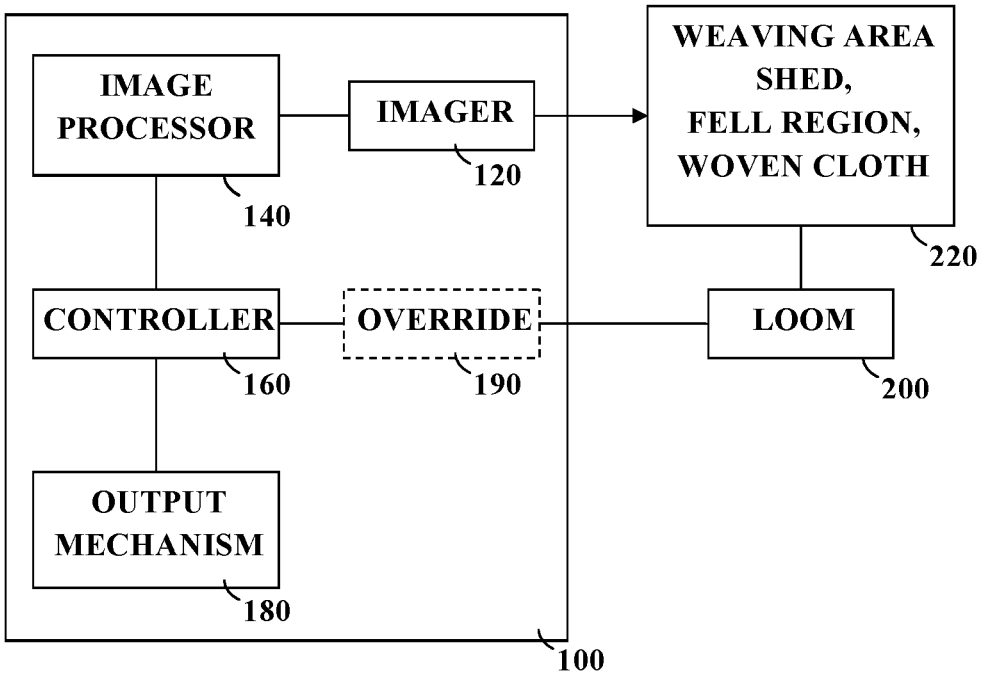
FIG. 1 is a block diagram representing the main components of a first embodiment of an on-loom fabric inspection system.

Reference is now made to the block diagram of FIG. 1 which represents the main components of an on-loom fabric inspection system 100. Such a system 100 may identify faults during the process of fabric manufacture thereby enabling early detection or prevention of fabric defects. On-loom systems 100 such as described herein may serve as a cost effective tool for providing continuous monitoring of woven textiles during production and may provide an industry standard for quality control of such fabrics.

The on-loom fabric inspection system 100 may include an imager 120, an image processor 140, a controller 160 and an output mechanism 180. The imager 120 is configured to collect image data from the weaving area 220 of a loom 200 and to transfer this data to the image processor 140.

Various imagers 120 may be used as suit requirements. For example, an array camera or the like may be used having a resolution suitable to detect individual yarns within woven fabric. Resolution of the imager 120 may be selected according to the cost and nature of the inspected fabric. Resolution may be less than 1 millimeter, perhaps around 0.1 millimeter as required.

The image processor 140 is operable to analyze image data received from the imager 120 and to identify irregularities in such data indicative of weaving faults. Various image processors 140 may be used with the system 100. A processor, such as a computer, a field programmable gate array, an application specific integrated circuit, a microprocessor may be selected to provide image processing at sufficiently fast rate. The processing rate may be fast enough to allow each frame imaged by the imager 120 to be analyzed in real time. Optionally, as noted below, the imager may be operable to segment each frame and to analyze each frame segment separately and possibly with individual sampling rates.

The controller 160 is provided to respond to the detection of weaving faults. The controller 160 may respond, for example, by outputting data to the output mechanism 180 which may comprise a database, a visual display unit, an alert or the like. Where required, the controller 160 may be further operable to activate an override switch 190 to stop or otherwise adjust the loom 200 in response to the detection of defects.

Figure 2A:
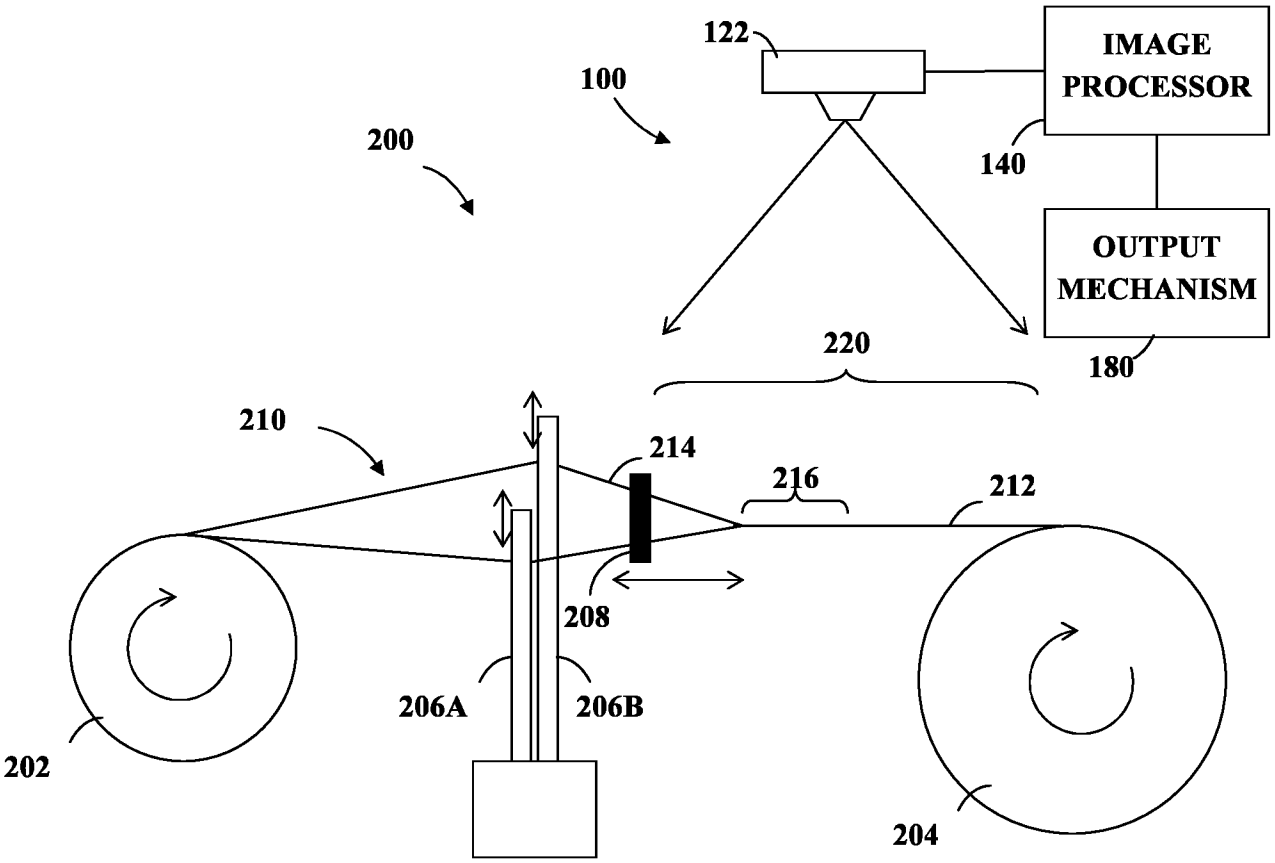
FIG. 2A is a schematic side view of a possible configuration of a fabric inspection system integrated onto a loom.

Reference is now made to FIG. 2A, which shows a schematic side view of a possible configuration of a fabric inspection system 100 integrated onto a loom 200. The loom 200 includes a yarn roll 202, a take-up roll 204, a pair of heald frames 206*a*, 206*b* and a reed 208. An array of warp yarns 210 are threaded through the heald frames 206A, 206B and the reed 208. The woven fabric 212 is collected by the take-up roll 204 as it is produced.

The heald frames 206A, 206B are configured to raise and lower the warp yarns thereby producing a shed 214 through which a filler yarn (not shown) may be inserted using some filling insertion mechanism (not shown) such as a shuttle, rapier, jet or the like. The reed 208 is provided to batten the filler yarn against the newly woven fabric 212.

The fabric inspection system 100 is configured to monitor a weaving area 220 including the newly woven fabric 212, the shed 214 and fell region 216. The fabric inspection system 100 includes one or more cameras 122 in communication with a processor. The processor 140, such as a computer or the like, is operable to receive and process data collected by the cameras 122. An output mechanism 180 such as a visual display unit associated with the computer may provide feedback to a user, such as images, measurements, statistical data and so on. It is noted that such a configuration of the on-loom fabric inspection system 100 may be operable to monitor the weaving area 220 during operation of the loom 200. Accordingly, a computer may be connected to the loom 200 and operable to stop the loom or otherwise adjust the loom settings in response to data gathered from the monitored weaving area 220.

Figure 2B:
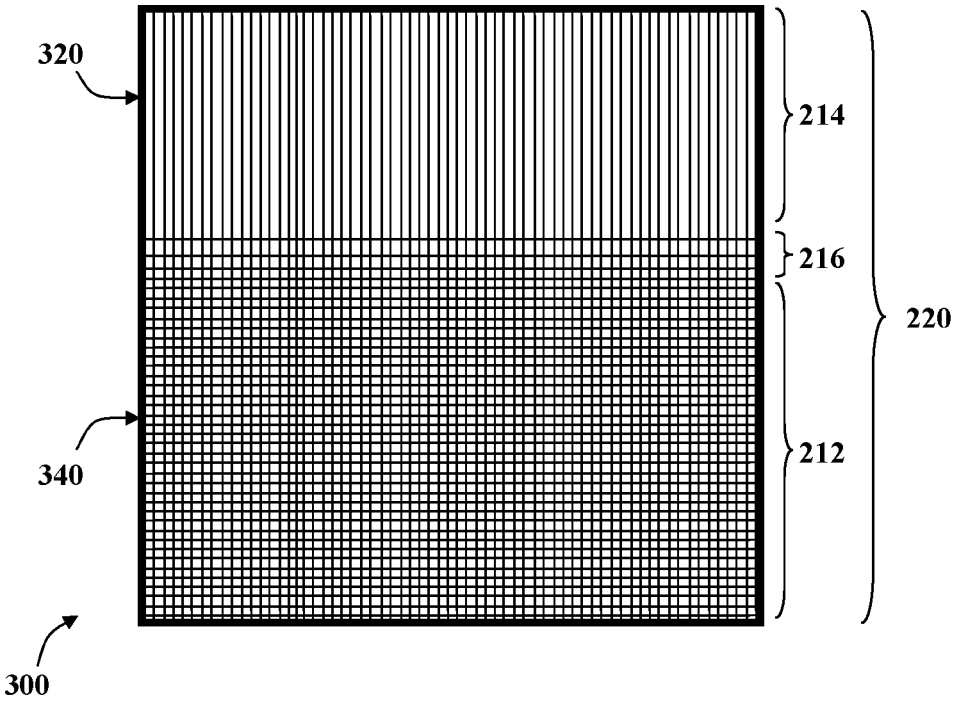
FIG. 2B is representation of one frame imaged by the on-loom fabric inspection system.

Referring now to FIG. 2B, a single frame 300 is represented such as may be obtained during monitoring by the on-loom fabric inspection system 100. The frame 300 shows the newly woven fabric 212, the shed 214 and the fell region 216. Images frames may be collected each time a filling yarn is introduced into the shed or each time the reed battens the fabric. The image data may be transferred to the image processor 140 which may analyze the frame 300 to detect weaving faults.

Weaving faults may occur in any of these areas of the frame 300 and may be detected using the on-loom fabric inspection system 100. For example, slubs, missing yarns, end outs and the like may be detected in the shed 214 and fell regions 216 whereas oil spots, loom stop marks, start marks and the like may be detected in the newly woven fabric 212.

Accordingly, the frame 300 may be divided into sub segments 320, 340 and the image processor 140 may analyze each segment separately. It is particularly noted that the sampling rate for each segment may be set separately. Thus, for example, a first frame segment 320 showing the shed 214 and fell region 216 may be analyzed in each frame collected such that faults may be detected quickly before defects develop. A second frame segment 340, showing the newly woven fabric 212, may be analyzed less frequently, after every 10 to 50 rows, say, such that larger defects such as oil spots may be detected without placing undue strain upon the image processor.

It will be further appreciated, that although only two frame segments are described hereinabove, a frame may be segmented variously into multiple segments.

Figure 3A:
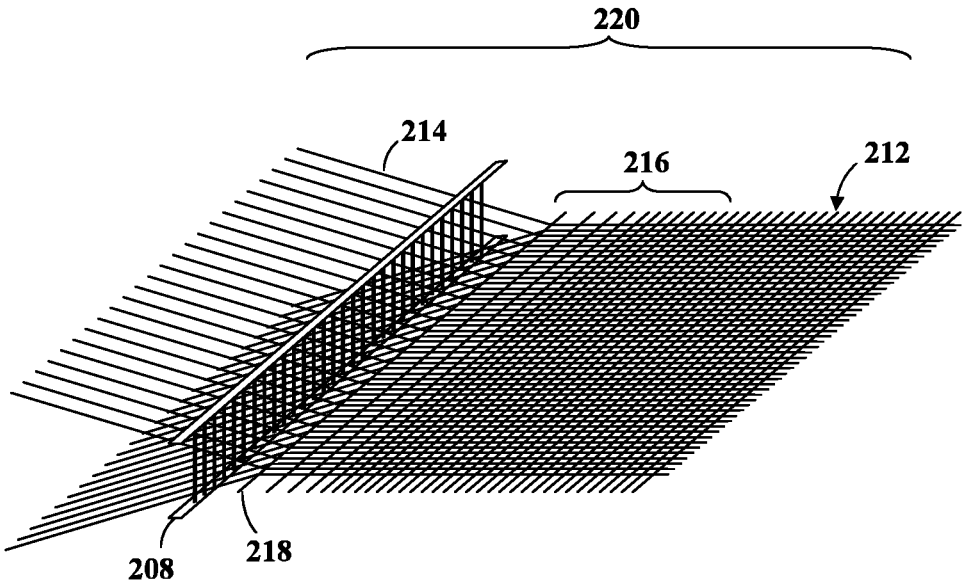
FIG. 3A is a schematic isometric view of the weaving area of a loom which may be monitored by the fabric inspection system.

Referring now to FIG. 3A, a schematic isometric view is shown of the weaving area 220 of a loom 200, which may be monitored by the fabric inspection system 100. The weaving area 220 including the newly woven fabric 212, the shed 214 and the fell region 216, is the active area of the loom 200 where the warp and weft yarns are woven into fabric.

Various faults occurring in the weaving area 220 during manufacture may cause defects in the finished fabric. These include slubs, holes, missing yarns, yarn variation, end out, soiled yarns, wrong yarn faults, oil spots, loom-stop marks, start marks, thin place, smash marks, open reed, mixed filling, kinky filling, mixed end, knots, jerk-in, dropped picks, broken picks, double picks, double ends, drawbacks, burl marks and the like.

Figure 3B:
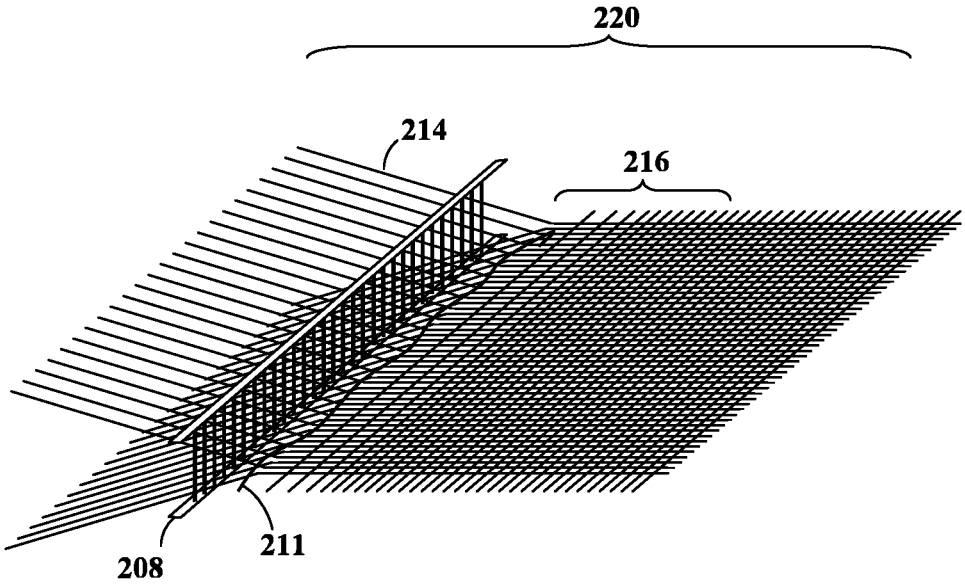
FIGS. 3B-F show various examples of weaving faults which may occur in the weaving area of the loom and which may lead to fabric defects.
Figure 3C:
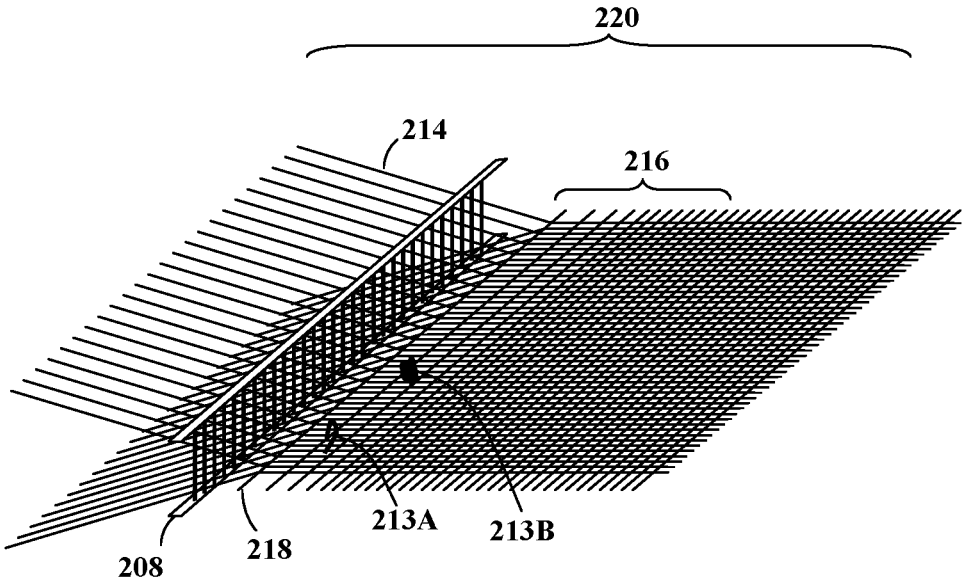
Figure 3D:
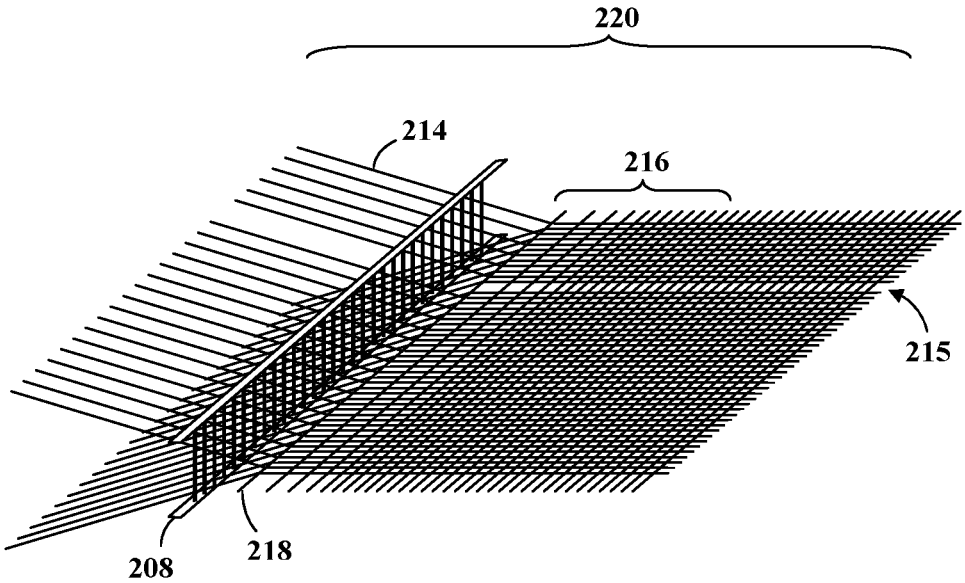
Figure 3E:
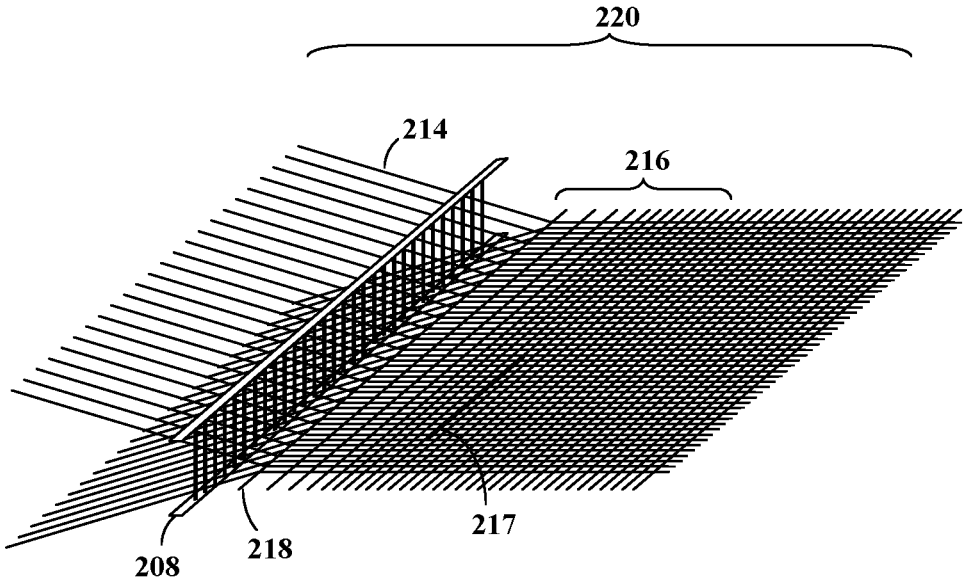
Figure 3F:
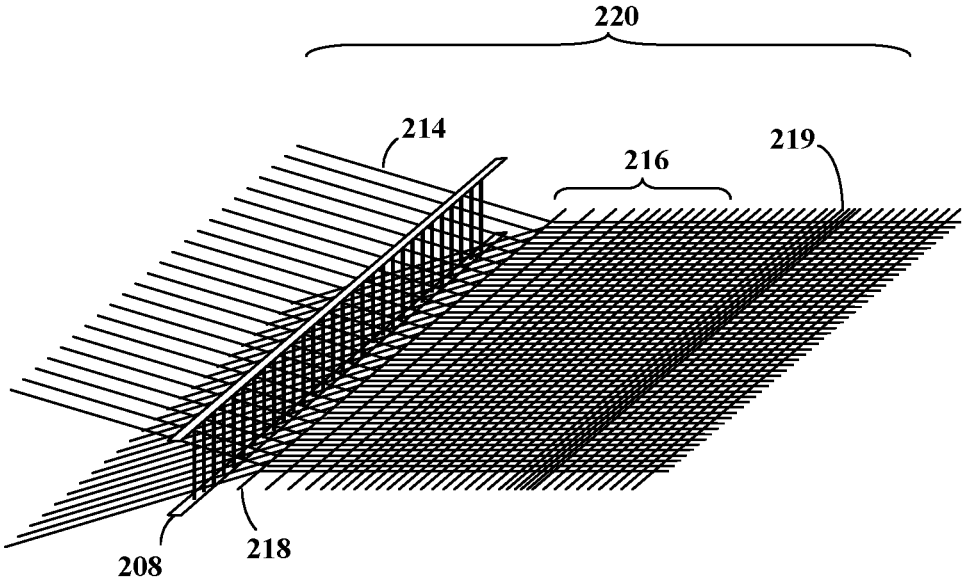

FIGS. 3B-F show selected examples of such defect causing faults occurring in the weaving area 220. In FIG. 3B a dropped pick fault is shown, in which the filling insertion mechanism fails to hold the filling yarn 211, causing a kinky yarn to be partially woven into the fabric. FIG. 3C shows a slub fault, in which an extra piece of yarn 213A or lint 213B is woven into the fabric. FIG. 3D shows an end-out fault, in which a warp yarn has broken leaving a gap 215 in the warp array. FIG. 3E shows an oil spot, caused by a soiled section 217 propagating along the woven fabric. FIG. 3F shows a start mark 219 fault in which an uneven battening rate results in a section of woven cloth having uneven weft threads in the woven cloth. It will be appreciated that all the above-described faults, amongst others, may be identified early from images collected by the imager 120 of an on-loom inspection system 100 such as described herein.

It is noted that for the sake of clarity, the schematic images of FIGS. 3A-F are presented with widely spaced yarns aiding demonstration of the faults. It will be appreciated however that yarns are typically highly compressed and consequently faults are typically difficult to identify by eye.

Figure 3G:
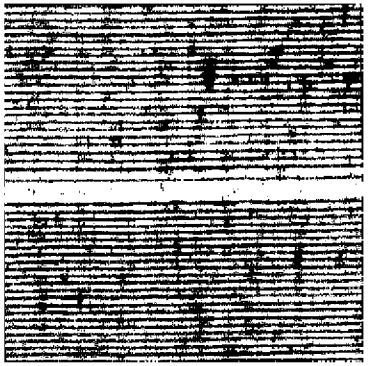
FIGS. 3G-M are a selection of images showing the appearance of a selection of weaving defects as they may appear in finished fabric.
Figure 3H:
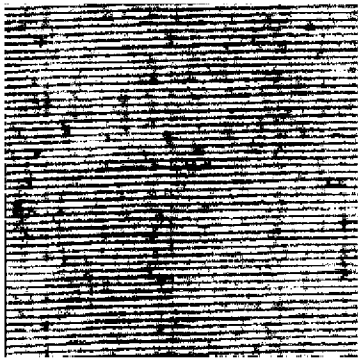
Figure 3I:
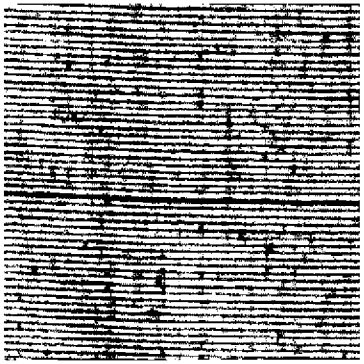
Figure 3J:
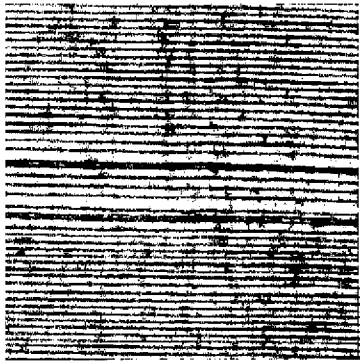
Figure 3K:
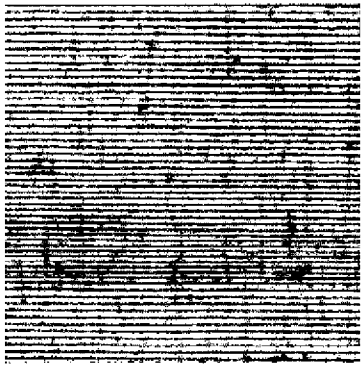
Figure 3L:
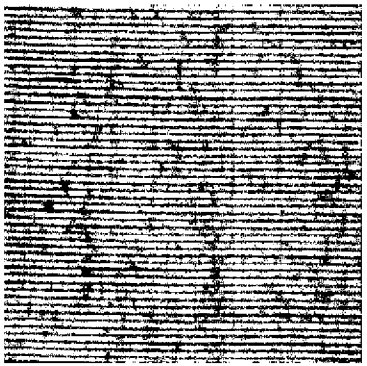
Figure 3M:
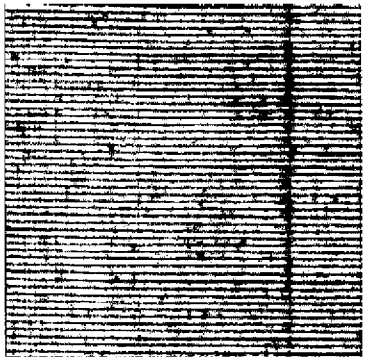

FIGS. 3G-M are a selection of enlarged images showing the appearance of a selection of weaving defects as they appear in finished fabric. FIG. 3G shows a thin place defect which develops when a filling fails to be introduced into the shed. FIG. 3H shows a kinky filling defect which develops when a filling insertion mechanism fails to hold the filling yarn such as represented in FIG. 3B. FIG. 3I shows a double pick defect which develops when two filling yarns are introduced through the shed before the heald frames reverse the warp yarns. FIG. 3J shows a broken pick defect which develops when a filling yarn breaks during introduction into the shed. FIG. 3K shows a start mark defect which develops when the loom stops or starts as represented above in FIG. 3F. FIG. 3L shows an end-out defect which develops when a warp yarn breaks as represented above in FIG. 3D. FIG. 3M shows a double end which develops when two warp yarns are threaded through a single heddle.

All the above-described defects may be detected or avoided by monitoring the loom using an inspection system monitoring the shed 214 and fell line 218.

It is particularly noted that, in contradistinction to the known art, the on-loom fabric inspection system 100 described herein monitors a weaving area 220 which includes the fell region 216 beyond the fell line 218. Referring back to FIG. 3A, although the weft-spacing in the finished fabric is generally uniform, in the fell region 216 the spacing between adjacent weft yarns 215 may become larger the closer the yarns are to the fell line 218.

The spacing of the weft yarns in the in the fell region 216 typically depends upon the force with which the reed 208 strikes the fell line 218 during operation. Accordingly, the spacing may indicate various weaving faults, leading to such defects as loom stop marks, start marks 219 and the like, which have been previously impossible to detect on the loom. It is a feature of the fabric inspection system 100 described herein that potential loom stop marks, start marks and the like may be identified during the weaving process and before the associated defects have developed.

Figure 4A:
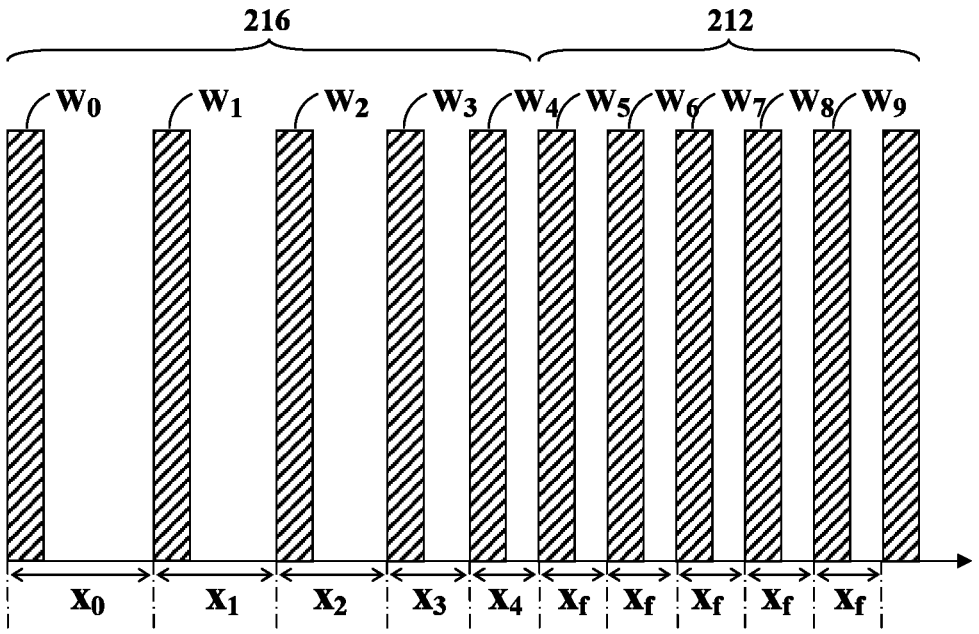
FIGS. 4A and 4B are schematic and graphic representations respectively of the spacing of weft yarns in the fell region during weaving.

FIG. 4A represents the spacing of weft yarns $w_{0-9}$ in the fell region 216 and in the newly woven fabric 212. It is noted that the weft-spacing is largest adjacent to the fell line 218 and decreases gradually until it reaches an approximately uniform value $x_f$ in the newly woven fabric 212.

Because of the uniform weft-spacing $x_f$ in the newly woven fabric 212, the weft density of the finished fabric is near constant giving the fabric has a uniform look and feel. Deviations from the uniform weft-spacing $x_f$ in the finished fabric may give rise to defects which, if sufficiently severe, may be conspicuous enough to render an item a second. Such deviations may be caused by irregularities in the reed cycle and battening rate such as when the loom is stopped during weaving.

On the loom during manufacture, the spacing $x_n$ between the each weft yarn $w_n$ and the adjacent weft yarn $w_{n+1}$, in the fell region 216, is typically larger than the desired uniform weft-spacing $x_f$ of the finished fabric. The fabric inspection system 100 described herein may be configured to monitor the larger weft-spacing $x_n$ in the fell region 216 in order to predict the occurrence of weaving defects resulting from deviations from the desired uniform weft-spacing $x_f$ of the finished fabric.

Figure 4B:
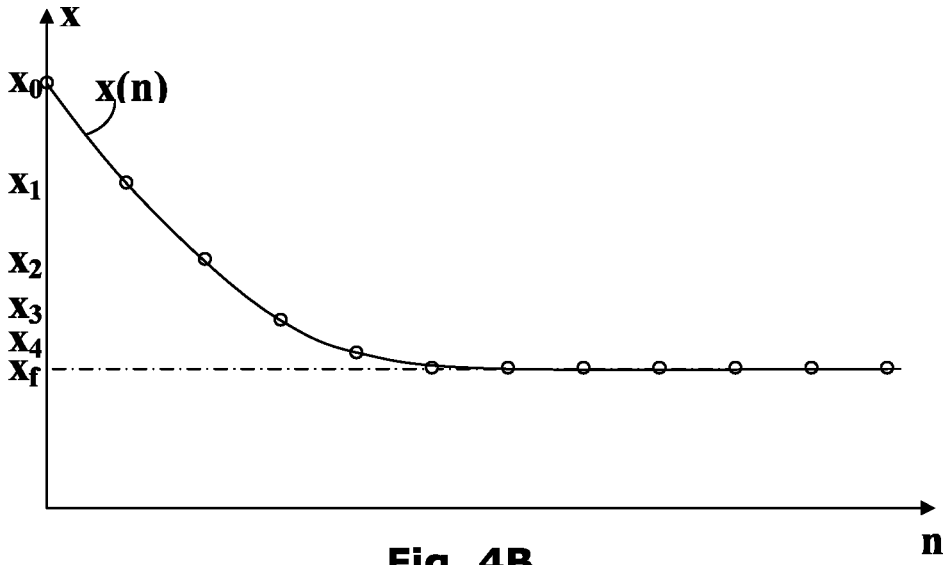

FIG. 4B is a graph showing an example of how the weft-spacing x(n) may behave as a function of number of yarns from the fell line during weaving. The spacing $x_n$ decreases from an initial value until it settles on a final uniform value $x_f$. The desired shape of the function will vary from application to application as it depends upon the nature of the loom, yarn, reed and such like.

A standard shape for the weft-spacing function x(n) may be defined for any given weave procedure. A tolerance may be set for how far the measured values of weft-spacing in the fell region 216 are permitted to deviate from the desired weft-spacing function x(n) during the manufacturing process.

In embodiments of the fabric inspection systems 100 disclosed herein, the imager 120 is able to collect image data from the fell region 216 during operation. Consequently the system is able to monitor the actual weft-spacing x during manufacture and to identify deviations from the desired weft-spacing function x(n) associated with the weave.

The image processor 140 analyzing image data received from the imager 120 may compare the actual weft-spacing in the fell region 216 to the desired weft-spacing function x(n) for each reed cycle or for selected cycles. Accordingly, the controller 160, may be configured to assign a value to the quality of a batch of fabric based, at least in part, upon the degree of its deviation from the desired weft-spacing function x(n). If the measured weft-spacings lie outside the tolerance range, the controller 160 may be configured to respond for example by labeling the woven fabric or otherwise indicating the roll as substandard.

Where appropriate the full weft-spacing function x(n) may be used to determine fabric quality. The nature of the weft-spacing function x(n) depends upon the yarns used and the loom cycle. For some applications, the function drops sharply and only one or two weft-spacings after the fell line may be larger than the final uniform value $x_f$. Thus the weft-spacing function x(n) may be an inappropriate measure and the absolute values of weft-spacings may be used as an indication of quality. Accordingly, in some embodiments the image processor 140 may be configured to analyze the absolute weft-spacing $x_1$ between the fell line and the first weft thread of the woven cloth. The image processor 140 may compare this value with the desired weft-spacing to check if it lies within the accepted tolerance level.

Where required, the controller 160 may be configured to adjust the loom settings, for example by changing the reed rate, roller speed, filling mechanism or the like, in order to correct the faults in order to maintain a high degree of uniformity in the weft density of the final fabric.

Accordingly, the on-loom fabric inspection system 100 disclosed herein may provide an objective assessment of the quality of a woven fabric. The assessment may be based on the actual number of faults detected by the images 120 in real time as the fabric is produced. Faults may be defined by standard threshold values which may be universally applied. It will be appreciated that such standardization of assessment of woven fabric represents a great improvement upon the currently used assessment methods which, as described above, depend upon the subjective assessment of an inspector.

Figure 5:
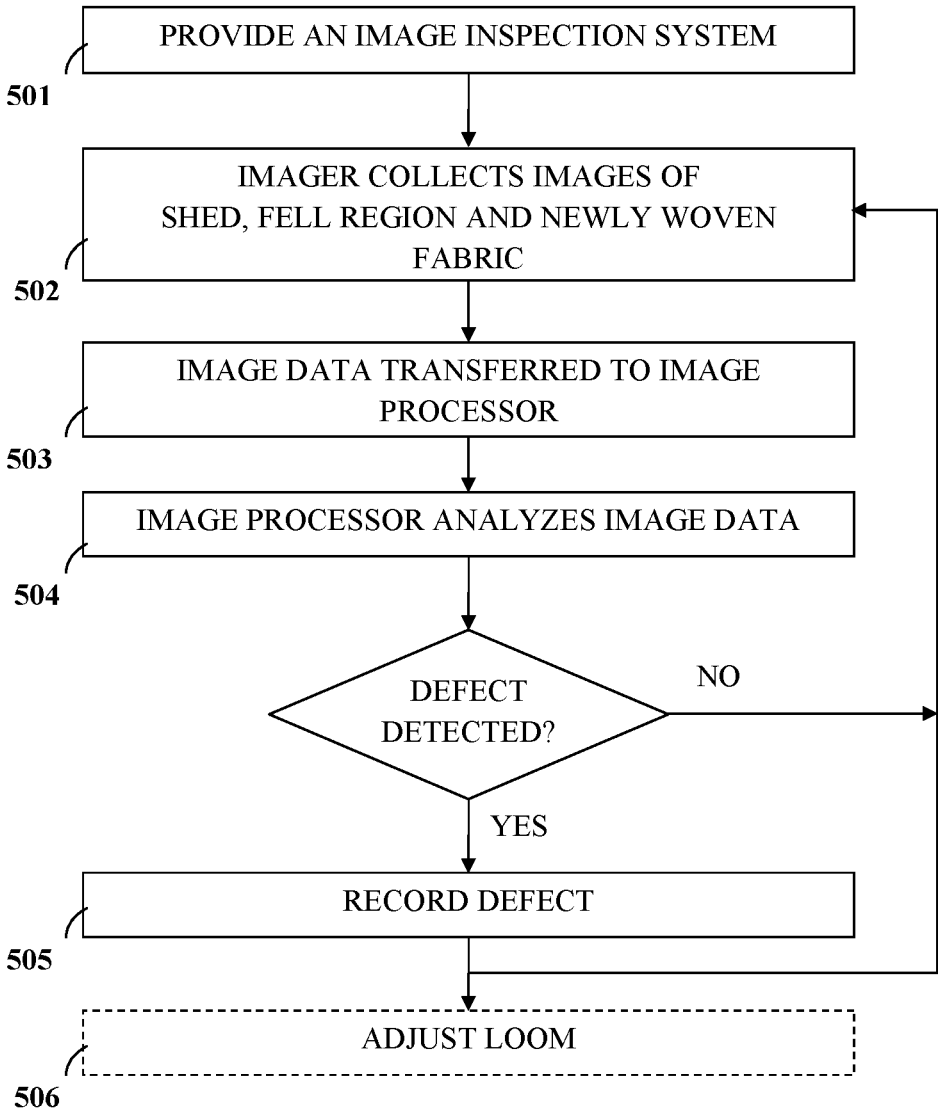
FIG. 5 is a flowchart representing a method for detecting defects in woven fabric using an on-loom fabric inspection system.

Reference is now made to the flowchart of FIG. 5 showing the steps in a possible method for detecting defects in woven fabric using an on-loom fabric inspection system 100 such as disclosed herinabove.

The fabric inspection system is provided—step (501). The imager then collects images of the fell region, newly woven fabric and the shed—step (502). Image data is transferred to an image processor—step (503). The image processor analyzes the image data—step (504). If an irregularity detected in the image data detects weaving faults from the image data indicates that a weaving fault has occurred then this fault is recorded—step (505). The process may continue by another image being collected and analyzed such that the process may be repeated. Optionally, the controller may be used to adjust the loom settings to correct for the fault—step (506).

It is noted that the recordation of the weaving fault may involve a simple fault count such as using a penalty point system such as the four-point for example. Alternatively more precise data relating to the types of faults detected and their statistical distribution for example may be recorded.

Figure 6:
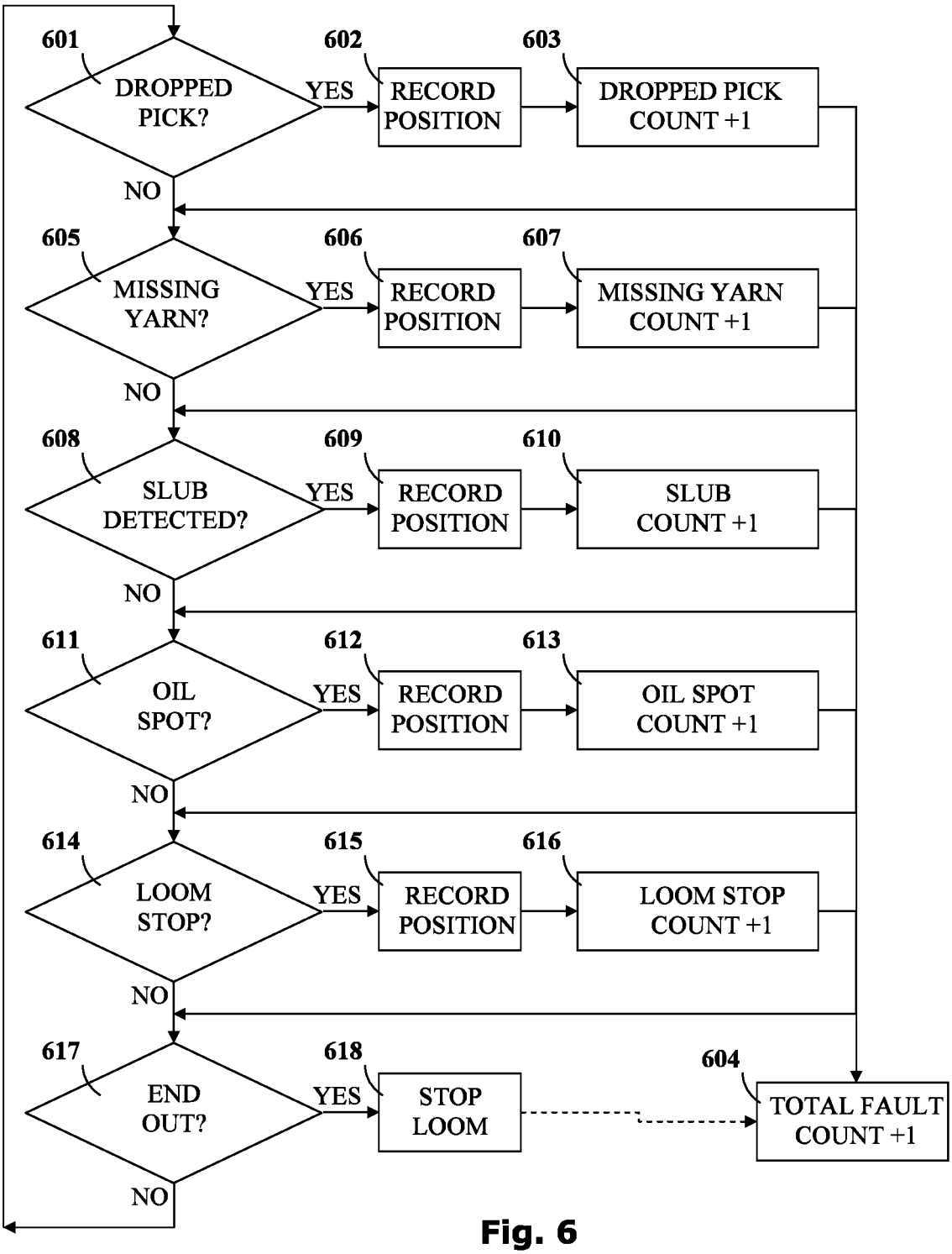
FIG. 6 is a flowchart representing a method for providing a quality index for a woven fabric.

The flowchart of FIG. 6 shows the steps of a possible more detailed method for recording the prevalence of certain defects. The method allows each type of fault to be recorded as well as its position. The method shows a system detecting the following selected faults: dropped pick faults, missing yarn faults, slubs, oil spots, loom stops and end outs. It will be appreciated the method may be extended to detect other additional weaving faults as required. It is noted that the method may further stop the loom altogether when a critical fault such as a line out is detected.

Accordingly, if a dropped pick is detected 601, its position may be recorded 602, a dropped pick count may be incremented by one 603 and the total fault count also incremented by one 604. Similarly, if a missing yarn is detected 605, its position may be recorded 606, a missing yarn counted incremented by one 607 and the total fault count also incremented by one 604. Similarly, if a slub is detected 608, its position may be recorded 609, a slub count may be incremented by one 610 and the total fault count also incremented by one 604. Similarly, if an oil spot is detected 611, its position may be recorded 612, an oil spot count incremented by one 613 and the total fault count also incremented by one 604. Similarly, if a loom stop is detected 614, its position may be recorded 615, a loom stop count may be incremented by one 616 and the total fault count also incremented by one 604. Optionally, where required, if a loom stop is detected 617 the loom may be stopped altogether 618 and the total fault count incremented by one 604.

The method of FIG. 6 provides only one example of a method for collecting a possible set of statistical data which may be used to provide a quality index for a roll of woven fabric. Other methods may alternatively be used as suit requirements. Thus, the fabric inspection system 100 disclosed herein may provide a tool enabling an objective quality index for each batch of woven fabric produced.

The scope of the disclosed subject matter is defined by the appended claims and includes both combinations and sub combinations of the various features described hereinabove as well as variations and modifications thereof, which would occur to persons skilled in the art upon reading the foregoing description.

In the claims, the word "comprise", and variations thereof such as "comprises", "comprising" and the like indicate that the components listed are included, but not generally to the exclusion of other components.

The invention claimed is:

1. An on-loom fabric inspection system comprising:

at least one imaging device configured to collect images of at least one section of a weaving area of a loom and to detect at least one fault in said weaving area;

wherein said section of the weaving area comprises all of a shed region, a woven fabric region and a fell region, said fell region being a section of the weaving area where a reed strikes a weft yarn along a fell line during operation of said loom.

2. The system of claim 1 further comprising at least one image processor configured to receive data pertaining to said images and to identify irregularities in said data.

3. The system of claim 2 wherein said image processor is configured to segment a frame of said image data and to analyze each segment separately.

4. The system of claim 3 wherein each segment is analyzed at a different rate.

5. The system of claim 3 wherein at least one segment shows the shed region.

6. The system of claim 3 wherein at least one segment shows the fell region.

7. The system of claim 3 wherein at least one segment shows the newly woven fabric region.

8. The system of claim 1 wherein said imaging device comprises a camera.

9. The system of claim 1 wherein said imaging device is configured to image a plurality of weft yarns in the fell region.

10. The system of claim 9 further comprising an image processor operable to measure weft-spacing.

11. The system of claim 1 further comprising an image processor operable to detect irregularities in image data indicating the occurrence of weaving faults.

12. The system of claim 11 wherein said weaving faults are selected from a group consisting of: slubs, holes, missing yarns, yarn variation, end out, soiled yarns, wrong yarn faults, oil spots, loom-stop marks, thin place, smash marks, open reed, mixed filling, mixed end, knots, jerk-in, dropped picks, drawbacks, burl marks and combinations thereof.

13. The system of claim 1 further comprising a controller operable to respond to detection of weaving faults.

14. The system of claim 13 wherein said controller is operable to stop the loom upon detection of critical weaving faults.

15. The system of claim 13 wherein said controller is operable to adjust the loom settings to correct for weaving faults.

16. The system of claim 13 wherein said controller is operable to assign a quality index to a batch of woven fabric.

17. The system of claim 16 wherein said quality index is at least partially based upon deviation of weft-spacing in the fell region from a desired weft-spacing function.

18. A batch of woven fabric assigned an objective quality index by a controller operable to receive data pertaining to images collected by an on-loom imaging device configured to image a plurality of weft yarns in all of a shed region, a woven fabric region and a fell region section of a weaving area where a reed strikes a weft yarn along a fell line during operation of a loom, said controller further operable to measure weft-spacing in the fell region, wherein said objective quality index is at least partially based upon deviation of said weft-spacing from a desired weft-spacing function.

* * * * *